US005687804A

United States Patent [19]

Lappalainen et al.

[11] Patent Number: 5,687,804

[45] Date of Patent: Nov. 18, 1997

[54] EQUIPMENT FOR HANDLING DRILL RODS

[75] Inventors: Juhani Lappalainen; Juha Piipponen, both of Tampere, Finland

[73] Assignee: Tamrock Oy, Tampere, Finland

[21] Appl. No.: 564,308

[22] PCT Filed: Jun. 8, 1994

[86] PCT No.: PCT/FI94/00245

§ 371 Date: Dec. 28, 1995

§ 102(e) Date: Dec. 28, 1995

[87] PCT Pub. No.: WO95/00737

PCT Pub. Date: Jan. 5, 1995

[30] Foreign Application Priority Data

Jun. 21, 1993 [FI] Finland ..... 932876

[51] Int. Cl.[6] ..... E21B 19/00

[52] U.S. Cl. ..... 175/52; 175/85

[58] Field of Search ..... 175/52, 85; 299/68; 211/69; 414/22.66

[56] References Cited

U.S. PATENT DOCUMENTS

| | | | |
|---|---|---|---|
| 3,420,319 | 1/1969 | Lincoln et al. . | |
| 3,835,938 | 9/1974 | Moody et al. | 175/52 |
| 4,632,618 | 12/1986 | Issakainen | 175/52 X |
| 4,892,160 | 1/1990 | Schivley, Jr. et al. | 175/52 X |
| 5,174,389 | 12/1992 | Hansen | 175/52 |

FOREIGN PATENT DOCUMENTS

| | | |
|---|---|---|
| 0 345 650 A2 | 12/1989 | European Pat. Off. . |
| 0 477 728 A1 | 4/1992 | European Pat. Off. . |
| 36144199 A1 | 12/1986 | Germany . |
| 1196159 | 9/1967 | United Kingdom . |
| 1290297 | 9/1972 | United Kingdom . |
| 1301430 | 12/1972 | United Kingdom . |

*Primary Examiner*—William P. Neuder

*Attorney, Agent, or Firm*—Nixon & Vanderhye P.C.

[57] ABSTRACT

Equipment for handling drill rods, comprising a slot-like storage space for storing drill rods side by side, a gripping jaw for gripping the drill rod, and a linearly movable displacing arm for displacing the drill rod from the outlet opening of the storage space by a linear movement to the drilling center of the drilling equipment and back. The equipment comprises a closing device positioned in the outlet opening of the storage space and movable in a direction transverse to the direction of movement of the displacing arm. The closing device has two inclined support surfaces facing away from the storage space, and the displacing arm similarly has an outwardly inclined guide surface at its end close to the storage space. On picking up a drill rod from the storage space, the gripping jaw presses the closing device at its support surface inwards so that the drill rod to be picked up is able to push the closing device inwards when the displacing arm is moved. Correspondingly, the guide surface of the displacing arm pushes the closing device inwards at its tip, so that the tip of the closing device bears against the surface of the displacing arm in such a way that they together close the outlet opening of the storage space during the displacing movement.

5 Claims, 2 Drawing Sheets

EQUIPMENT FOR HANDLING DRILL RODS

Figure 1:
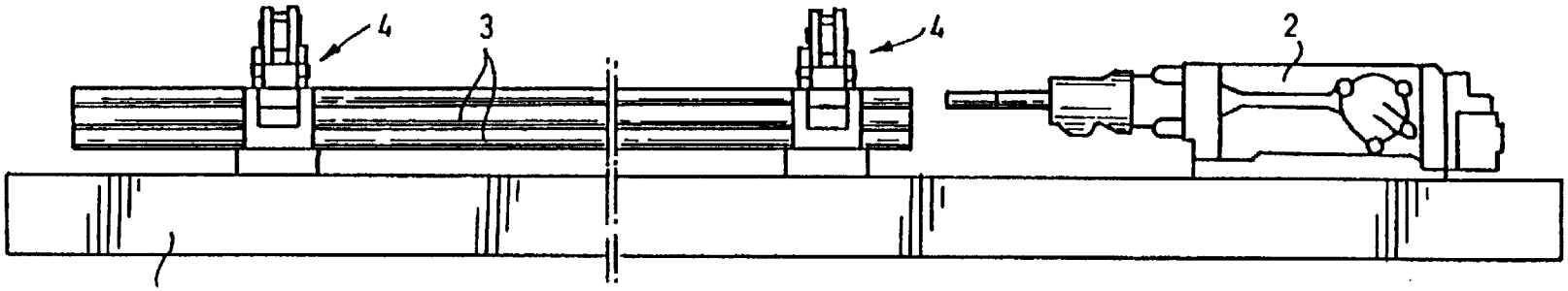

The invention relates to an equipment for handling drill rods, comprising a slot-like storage space intended for drill rods and having an outlet opening; a closing device for closing the outlet opening of the storage space; a displacing arm for displacing the drill rods between the outlet opening of the storage space and a drilling centre by a liner displacing movement; a power means for displacing the displacing arm; a gripping jaw connected to the displacing arm turnably about a transverse axis for gripping and holding the drill rod; and a power means for turning the gripping jaw to a gripping position and away from it.

Long-hole drilling utilizes drill rods or steels stored in various storage means, such as rotating cartridges, from where the rods are displaced to a drilling centre by very complicated displacing means. As used in this patent application and claims, drill rods refer to drill rods, drill steels, drill pipes, and other similar rod-like components used in long-hole drilling. Typically, a rod is displaced by a turning movement, whereby arms turnable about an axis parallel with the drilling axis displace the rod to the drilling centre or away from it. Very complicated functions and devices are required to carry out this operation. Such devices are difficult to use and expensive to produce, and their complexity causes a constant risk of disturbance. Such disturbances are typically caused by the rotatory movement of the rod cartridge, the clamping movement of the rod displacement arms for clamping the rods, and the turning movement of the arms from one position to another. Such solutions are disclosed e.g. in British Patents 1 196 159 and 1 290 297 and U.S. Pat. No. 3,420,319. The first-mentioned patent specification discloses a solution where rods are positioned in a curved cartridge, from which they are displaced to the drilling centre by three separate curvilinear movements, which makes the equipment difficult to control.

British Patent 1 290 297 in turn discloses a solution where oil-drilling pipes are stored in a straight cartridge, and they are displaced to the drilling centre by a separate, linearly movable displacing means. The solution requires a separate complicated mechanism for controlling stored pipes during the displacing movement, and it is difficult to use. The displacing means of the equipment disclosed in the above-mentioned patent is described more fully in British Patent 1 301 430, from which it appears that the solution comprises a plurality of different gripping means and closing arrangements, while the pipes, however, are able to move longitudinally of the storage when the storage is not full.

U.S. Pat. No. 3,420,319 in turn discloses a solution where drill pipes are stored in a straight storage container, and they are displaced to the drilling centre by displacing the drill pipe cartridge.

A further disadvantage of the prior art solutions is that to learn to control several successive movements in normal drilling is time-consuming and causes risk situations at work. In the same way, all additional movements increase the waste time in the handling of a drill rod, thus making the drilling process slower. Moreover, when turnable arms are used, they have to be interconnected mechanically by a connection pipe or the like in order that they would turn simultaneously. Correspondingly, the arms have to be mounted turnably with respect to the frame, which makes the structure expensive and heavy.

An object of the present invention is to provide an equipment for handling drill rods, which allows drill rods to be stored reliably and safely and which allows the rods to be controlled all the time. Another object of the invention is to provide an equipment which is simple and easy to realize. The invention is characterized in that the closing device and the displacing arm are mounted transversely movably with respect to each other so that when the displacing arm has been moved towards the drilling centre or when the gripping jaw is open, they together close the outlet opening of the storage space; that the displacing arm has an inclined guide surface on the side of the closing device, the guide surface pushing the closing device at its end in a direction away from the displacing arm when the displacing arm is pushed towards the drilling centre; that the closing device has a support surface inclined in a direction away from the end of the closing device on the side of the drilling centre, the drill rod to be inserted into the storage space bearing against said support surface, thus pushing the closing device in a direction away from the displacing arm; and that the closing device has a second support surface at a distance from its end on the side of the drilling centre, the gripping Jaw bearing against said second support surface in its turned position, thus pushing the closing device in a direction away from the displacing arm.

An essential feature of the invention is that the rods are positioned side by side in a slot-like storage space which comprises a power means, such as a spring or a hydraulic cylinder, pushing the rods outwards, and from which the rods are picked up or into which they are inserted one by one. Another essential feature of the invention is that it comprises a closing device which allows the rods to leave the storage space only when the gripping jaw grips the rod and takes it out. Still another essential feature of the invention is that the displacement of the rod from the outlet opening of the storage space to the drilling centre takes place by a linear movement, whereby the displacing arm locks the drill rod storage space and the rods placed in it in position during the displacing movement. A further essential feature of the invention is that the closing device comprises two inclined support surfaces facing the drilling centre and positioned at different points both in the direction of movement of the closing device and in the longitudinal direction of the drill rod. The drill rod or the gripping jaw pushes the closing device aside at these surfaces so that the drill rod can be displaced out of the storage space and into the storage space, respectively. The displacing arm similarly comprises an inclined guide surface which pushes the closing device inwards when the displacing arm is moved towards the drilling centre, whereby the closing device is displaced so that it bears against a surface of the displacing arm on the side of the drill rods in such a manner that the displacing arm and the closing device form a closed storage space and close together the inlet opening of the space.

The equipment according to the invention allows the drill rod to be displaced to the drilling centre from the storage space and correspondingly back from the drilling centre into the storage space by two control movements which are easy to learn and which effect the displacing movement efficiently. Furthermore, in the storage space and during the displacement, the rods are under constant control and secured so that no accidents and damages will take place.

Figure 3:
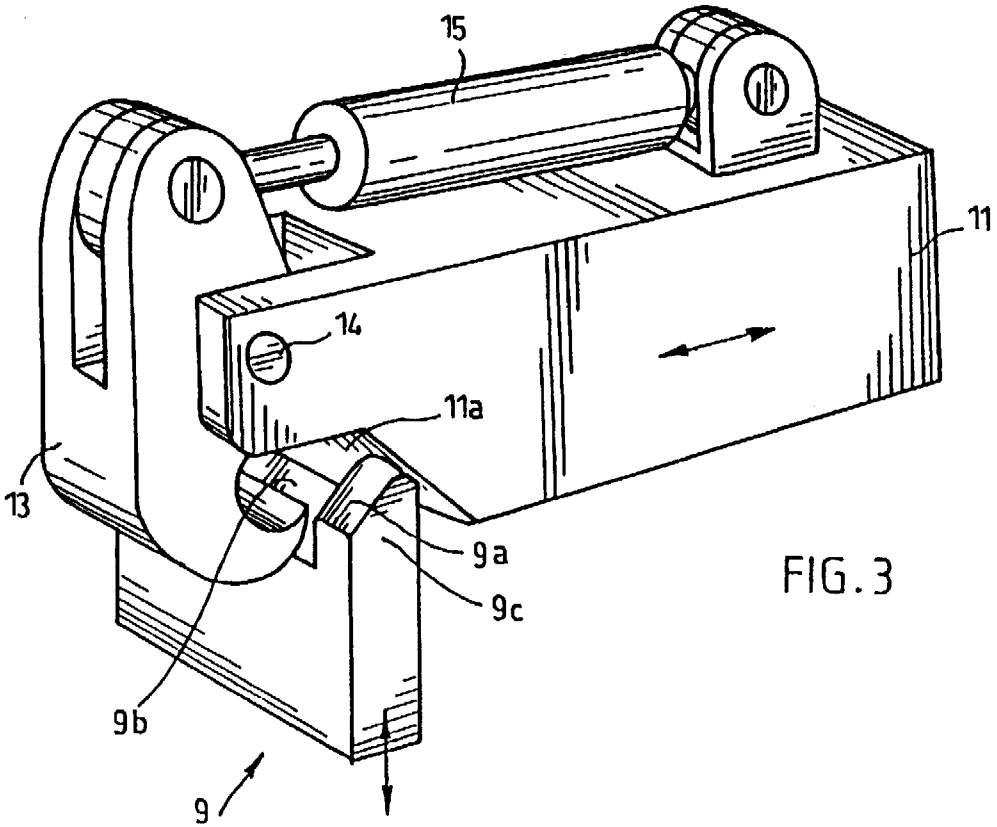

The invention will be described more fully with reference to the attached drawings, in which FIG. 1 is a schematic side view of an equipment according to the invention for handling drill rods;

FIGS. 2*a* to 2*e* illustrate the operation of the equipment according to the invention as seen in the direction of the axis of the drill rod; and FIG. 3 is a perspective view of one embodiment of a displacing arm, gripping jaw and closing device in an equipment according to the invention.

FIG. 1 shows a feeding beam 1 for a drilling machine 2, along which beam the drilling machine is movable. Further, an equipment for handling drill rods 3 is connected to the feeding beam 1. The equipment comprises two handling units 4, the structure and operation of which will be described in greater detail with reference to the other figures. In the handling units 4 the drill rods are stored in parallel with the feeding beam 1 in such a way that they are at a distance from the drilling centre of the drilling machine and transverse to a line drawn from the drilling centre towards the storage space and positioned side by side so that the outermost drill rod 3 is always in the same plane as the drilling centre of the drilling machine in the direction of the displacing movement of the handling units 4 when the equipment is in a drilling position.

FIGS. 2*a* to 2*e* show the equipment according to the invention as seen in the direction of the drill rods. The figures show a frame 5 of the handling unit 4. The frame is attached to the feeding beam 1 by a supporter 6. It is provided with a slot-like storage space 7 for the drill rods 3, and a spring 8 is provided at the bottom of the storage space, which spring pushes the drill rods 3 outwards from the storage space 7, thus keeping the rods pressed against each other. Beside the storage space 7 there is provided a closing device 9 movable in its own space and pushed by a closing spring 10 in the same direction as the spring 8 of the storage space 7 pushes the drill rods. Furthermore, a displacing arm 11 is connected to the frame 5 slideably in its longitudinal direction and transversely to the storage space 7. To displace the displacing arm 11 a displacing cylinder 12 is connected between it and the frame 5. The displacing arm 11 further has an associated gripping jaw 13 which is connected turnably about an axis 14 parallel with the drill rods 3 with respect to the displacing arm 11. To turn the gripping jaw, a gripping cylinder 15 is arranged to act between the displacing arm 11 and the gripping jaw 13.

Figure 2A:
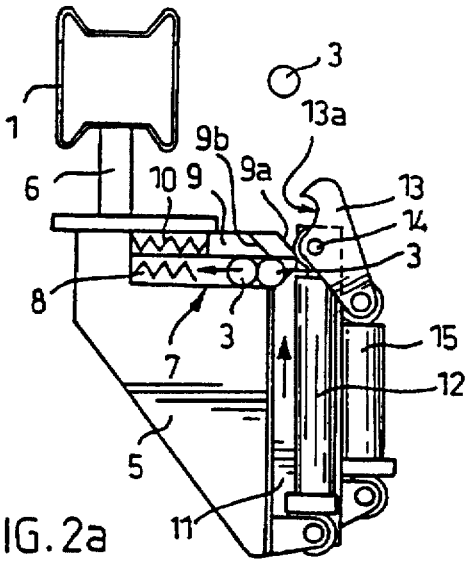
Figure 2B:
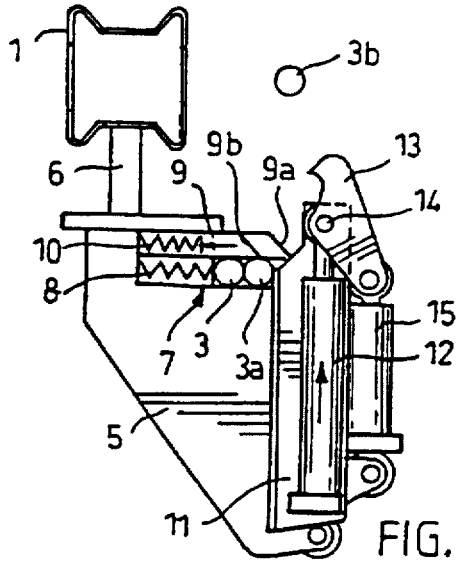
Figure 2C:
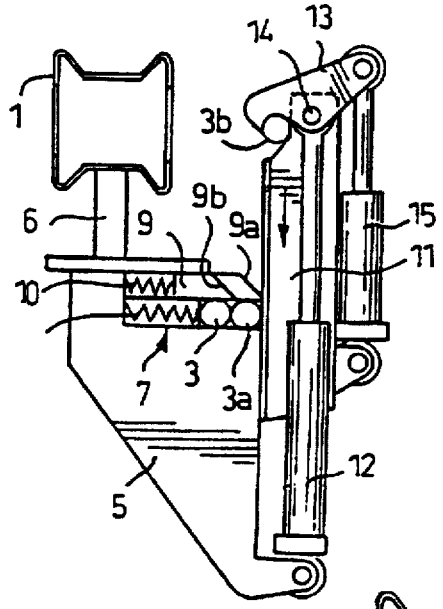
Figure 2D:
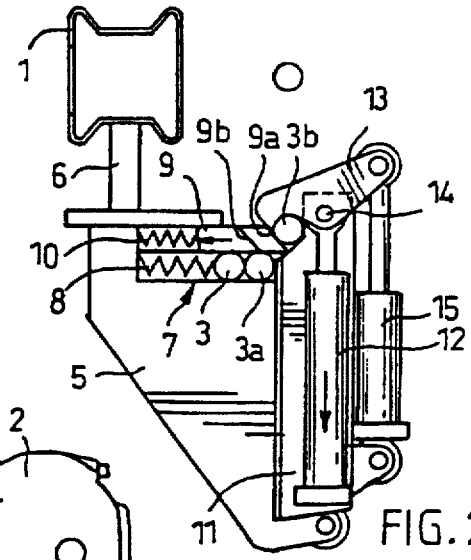
Figure 2E:
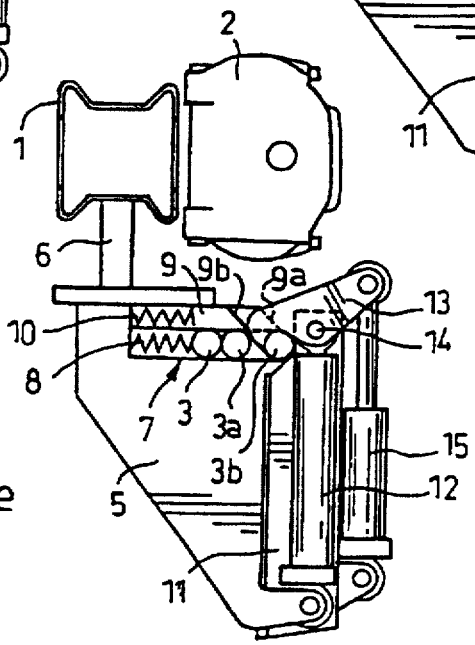

FIGS. 2*a* to 2*e* show schematically how the closing device 9 is arranged to operate under the influence of the displacing arm 11, the gripping jaw 13 and the drill rods 3, so that it does not need a separate operating means. It appears from FIG. 2*a* how the closing device 9 is in its outermost position when the displacing arm 11 is in its most retracted position, whereby the closing device 9 and the displacing arm 11 prevent the drill rods 3 from falling out of the storage space 7. The closing device 9 comprises, on the side of the drilling centre, at least two inclined support surfaces 9*a* and 9*b* spaced apart from each other in the direction of movement of the closing device and positioned at different points in the axial direction of the drill rods 3. This is illustrated more closely in FIG. 3. The end of the displacing arm 11 close to the closing device 9 also has an inclined guide surface 11*a*. When the displacing arm moves upwards in a direction shown by the arrow in FIG. 2*a*, the guide surface 11*a* first pushes the topmost drill rod 3*a* inwards and then similarly pushes the closing device 9 inwards, as shown in FIG. 2*b*, thus forming a barrier in front of the storage space 7, which barrier prevents the drill rods 3 from falling out of the storage space 7. When the displacing arm 11 is fully extended, the drill rod 3*b* positioned at the drilling centre 12 can be gripped by turning the gripping jaw 13 in such a way that a rod slot 13*a* formed in it is positioned around the drill rod 3*b*, squeezing it against the guide surface 11*a* of the displacing arm 11. In this position the displacing arm 11 can be retracted, i.e. displaced downwards in the figure, so that the drill rod 3*b* will be displaced to the opening of the storage space 7. When the drill rod 3*b* reaches the closing device 9, the closing device 9 may slide over a distance outwards along the guide surface 11*a*, when the displacing arm 11 is retracted. However, as shown in FIG. 2*d*, the drill rod 3*b* comes into contact with the outermost support surface 9*a* of the closing device 9, thus again forcing the closing device aside so that the drill rod 3*b* is able to pass the closing device 9 and enter the storage space 7. Thereafter, when the gripping jaw 13 is opened by shortening the length of the gripping cylinder 15, the closing device 9 is able to move outwards, thus locking the drill rod 3*b* in the storage space 7. FIG. 2*e* shows how the drill rod to be displaced has reached the storage space, and the gripping jaw 13 presses the closing device at its other support surface 9*b* inwards while the tip of the closing device 9 is in a position displaced from the central line of the drill rod 3 towards the storage space. When the gripping jaw 13 is turned open by shortening the gripping cylinder 15, as shown in the figure, the closing device 9 is able to move to the right in the figure, thus locking the drill rod 3*b* reliably in place.

On removing the drill rods 3, 3*a*, 3*b* from the storage space 7, the operation is reversed except that when the gripping jaw 13 is first turned to grip the first drill rod 3*b* in the storage space 7, it presses the support surface 9*b* of the closing device 9, thus forcing the closing device 9 inwards. It thereby locks the drill rod 3*b* against the guide surface 11*a* of the displacing arm 11, and the tip of the closing device 9 will be positioned at the drill rod 3, i.e. between its central axis and its edge facing the storage space 7, in a position such that when the displacing arm 11 is pushed onwards, the tip of the closing device 9 hits the inclined surface portion of the drill rod 3*b*, and is displaced downwards under the influence of the drill rod 3*b* until it is able to return to a position against the guide surface 11*a* of the displacing arm 11 and is again displaced aside to make room for the displacing arm 11 under the guidance of the guide surface. The drill rod 3*b* can thereafter be displaced to the drilling centre 12, the gripping jaw 13 can be opened, and the displacing arm 11 can be retracted. Accordingly, the drill rod 3, 3*a*, 3*b* is supported by the closing device 9, the displacing arm 11 and the gripping jaw 13 in all situations so that it will not fall by accident from the storage space or escape from the handling unit.

FIG. 3 is a perspective schematic view of one embodiment of the equipment according to the invention, comprising the closing device 9, the displacing arm 11, and the gripping jaw 13 with the power means 15. As appears from the figure, the closing device 9 has at its edges the support surfaces 9*a* and 9*b*, which are positioned at different depths in the direction of the closing device. In practice, there are two symmetrically positioned support surfaces 9*a*, one in each projection 9*c* at the outer edges of the closing device 9 in such a way that the gripping jaw 13 can pass between the surfaces. It further appears from the figure how the gripping jaw 13 is positioned with respect to the closing device 9 when it has been turned from its most open position towards the gripping position. The figure also shows how the guide surface 11*a* of the displacing arm 11 makes contact with the upper end of the projection 9*c* of the closing device 9, whereby it has a similar contact with the ends of the projections 9*c* at both edges. For practical reasons, the upper corner of the closing device 9 is rounded in order that the movement and mutual sliding of the surfaces would take place as smoothly as possible. The figure does not show the frame structures and other components less important for the understanding of the relationship between the above-mentioned three components, as they are shown in the other figures. When the equipment according to the invention is realized as shown in the figures, it can be operated in such a way that the closing device 9 and the operating means 8 forcing the rods outwards do not need a separately controllable operating means but it is able to operate reliably and safely under the guidance of the displacing arm and the gripping jaw.

The invention has been described above and shown in the drawings only by way of example, and it is not in any way restricted to the example. There may be one or more handling units provided in a single equipment, whereby the most suitable and advantageous solution is to use two handling units. The storage space may be linear or curved, depending on the application, provided that the drill rods are arranged such that one rod at a time is able to enter the outlet opening of the storage space beside the closing device and the displacing arm. The closing device 9 may be realized either by using merely the two support surfaces 9*a* and 9*b* or, as shown in FIG. 3, by using a symmetrical closing structure having support surfaces in the middle or at both edges such that a force is exerted on the closing device 9 substantially symmetrically with respect to its centre in the longitudinal direction. In this way, the extra wear usually caused by asymmetrical loading is avoided, even though the use of the structure is not absolutely necessary.

We claim:

1. Equipment for handling drill rods including a slot-like storage space intended for drill rods and having an outlet opening; a closing device for closing the outlet opening of the storage space; a displacing arm for displacing the drill rods between the outlet opening of the storage space and a drilling centre of a drilling machine by a linear displacing movement; a power means for displacing the displacing arm; a gripping jaw connected to the displacing arm turnably about a transverse axis for gripping and holding the drill rods; and a power means for turning the gripping jaw between an open position and a gripping position; wherein the closing device and the displacing arm are mounted transversely movably with respect to each other so that when the displacing arm has been moved towards the drilling centre or when the gripping jaw is in the open position, the closing device and the displacing arm together close the outlet opening of the storage space; and wherein the displacing arm has an inclined guide surface on one side of the closing device, the guide surface pushing the closing device at an end thereof in a direction away from the displacing arm when the displacing arm is pushed towards the drilling centre; and wherein the closing device has a first support surface inclined in a direction away from said end of the closing device on the side of the drilling centre, the drill rod to be inserted into the storage space bearing against said support surface, thus pushing the closing device in a direction away from the displacing arm; and further wherein the closing device has a second support surface at a distance from said end on the side of the drilling centre, the gripping jaw when in the gripping position bearing against said second support surface, thus pushing the closing device in a direction away from the displacing arm.

2. Equipment according to claim 1, including a closing spring pushing the closing device towards the displacing arm; and a spring pushing the drill rods towards the outlet opening of the storage space.

3. Equipment according to claim 1, wherein the second support surface of the closing device has such dimensions with respect to the gripping jaw that the end of the closing device on the side of the displacing arm extends between the central axis of the drill rod at the outlet opening of the storage space and an edge of the drill rod on the side of the storage space in such a way that when the drill rod is displaced towards the drilling centre, the surface of the drill rod is able to push the closing device in a direction away from the displacing arm so that the drill rod can be moved from the storage space, and correspondingly when the drill rod is inserted into the storage space, the closing device keeps the drill rod in the storage space when the gripping jaw is opened.

4. Equipment according to claim 1, wherein the closing device is substantially symmetrical so that edges of said closing device comprise a pair of projections, both of which extend up to the displacing arm and form said first inclined support surface against which the drill rod is arranged to bear; and wherein the closing device has a central recess where said second support surface for the gripping jaw is formed; and further wherein the gripping jaw has such dimensions in the transverse direction of the closing device that the gripping jaw is able to pass between the projections of the edges of the closing device through the recess of the closing device.

5. Equipment according to claim 1, wherein the storage space, the closing device, the displacing arm, the power means for the displacing arm, the gripping jaw and the power means belong comprise a separate handling unit; and wherein the equipment comprises two such handling units spaced apart from each other along a feeding beam extending in the longitudinal direction of the drilling machine.

* * * * *